US009397412B2

(12) United States Patent
Schmidt et al.

(10) Patent No.: US 9,397,412 B2
(45) Date of Patent: Jul. 19, 2016

(54) IDC CONTACT ELEMENT FOR AN ELECTRICAL PLUG

(71) Applicant: Tyco Electronics AMP GmbH, Bensheim (DE)

(72) Inventors: Ralf Schmidt, Fuerth (DE); Martin Szelag, Bickenbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/541,282

(22) Filed: Nov. 14, 2014

(65) Prior Publication Data

US 2015/0072551 A1 Mar. 12, 2015

Related U.S. Application Data

(63) Continuation of application No. PCT/EP2013/059559, filed on May 8, 2013.

(30) Foreign Application Priority Data

May 14, 2012 (EP) ..... 12167940

(51) Int. Cl.

| | |
|---|---|
| ***H01R 4/24*** | (2006.01) |
| ***H01R 12/51*** | (2011.01) |
| ***H01R 13/24*** | (2006.01) |
| *H01R 12/71* | (2011.01) |

(52) U.S. Cl.

CPC ..... *H01R 4/2425* (2013.01); *H01R 4/2433* (2013.01); *H01R 12/515* (2013.01); *H01R 13/2428* (2013.01); *H01R 4/242* (2013.01); *H01R 12/714* (2013.01)

(58) Field of Classification Search

USPC ..... 439/395–400

See application file for complete search history.

(56) References Cited

U.S. PATENT DOCUMENTS

| | | | | |
|---|---|---|---|---|
| 3,805,214 | A * | 4/1974 | Demler, Sr. | H01R 43/015 439/399 |
| 4,312,556 | A * | 1/1982 | Dufau | H01R 4/2445 439/399 |
| 4,363,529 | A * | 12/1982 | Loose | H01R 4/2462 439/746 |
| 4,560,226 | A * | 12/1985 | Dennis | H01R 12/675 439/395 |
| 5,030,121 | A * | 7/1991 | Noorily | H01R 13/28 439/188 |
| 5,118,305 | A | 6/1992 | Hell et al. | |

(Continued)

FOREIGN PATENT DOCUMENTS

| | | |
|---|---|---|
| DE | 10111571 A1 | 2/2002 |
| WO | 8900345 | 1/1989 |

OTHER PUBLICATIONS

PCT Notification of Transmittal of the International Search Report and the Written Opinion of the International Searching Authority, or the Declaration, International Application No. PCT/EP2013/059559, dated Jul. 9, 2013, 13 pages.

*Primary Examiner* — Tho D Ta
(74) *Attorney, Agent, or Firm* — Barley Snyder

(57) ABSTRACT

The invention relates to an IDC (Insulation Displacement Connector) contact for an electrical plug. The IDC contact includes a wire contact section and a secondary contact section. The wire contact section includes a cable receiving opening at a proximal end thereof and extending into a slotted cable receiving section. The secondary contact section includes a contact spring extending from and positioned adjacent to the wire contact section and a contact arm extending from the contact spring and extending to a contact point.

34 Claims, 12 Drawing Sheets

(56) References Cited

U.S. PATENT DOCUMENTS 5,242,314 A * 9/1993 Di Giulio ..... H01R 12/714 439/289
5,588,859 A 12/1996 Maurice
5,641,312 A * 6/1997 Bippus ..... H01H 85/54 439/709
6,280,230 B1 8/2001 Takase et al.
6,280,231 B1 * 8/2001 Nicholls ..... H01R 4/2429 439/402
6,290,524 B1 9/2001 Simmel
7,572,140 B2 8/2009 Szelag et al.
2005/0272298 A1 * 12/2005 Miyoshi ..... H01R 4/2433 439/395
2007/0270009 A1 11/2007 Schneider Nee Hild et al.
2009/0311888 A1 12/2009 Ko et al.
2010/0252764 A1 * 10/2010 Schalowski ..... B60T 8/3675 251/129.15
2012/0080626 A1 * 4/2012 Fuerst ..... B60T 8/3675 251/129.15

* cited by examiner

IDC CONTACT ELEMENT FOR AN ELECTRICAL PLUG

CROSS-REFERENCE TO RELATED APPLICATIONS

This application is a continuation of PCT International Application No. PCT/EP2013/059559, filed May 8, 2013, which claims priority under 35 U.S.C. §119 to EP Patent Application No. 12167940.1, filed May 14, 2012.

FILED OF THE INVENTION

The invention relates to a contact and, in particular, an insulation displacement connector (IDC) contact for an electrical plug.

BACKGROUND

IDC contacts are generally known and commonly used with an electrical plug, in particular in a cable clamping electrical plug. For example, U.S. Pat. No. 7,572,140 B2 discloses a known IDC contact having a wire contact section for cutting through an insulation of a cable and contacting a wire of the cable and a contact spring that contacts a printed circuit board (PCB) by pushing a contact area on the contact spring onto the PCB. An opening of the wire contact section and the contact area are both located on a proximal end of the known IDC contact facing the cable and the PCB, which helps to reduce the length of the IDC contact in a contact direction.

DE 101 1 1 571 B4 also discloses a known IDC contact having two wire contact sections that contact the wire of a cable by cutting through the insulation of the cable, and two contact springs at the opposite end for contacting an electrical conductor that can be located between the two contact springs.

Both known IDC contacts are generally large, which makes them unsuitable for high frequency and especially large bandwidth transmissions.

SUMMARY

Accordingly, an IDC contact is provided for an electrical connector. The IDC contact includes a wire contact section and a secondary contact section. The wire contact section includes a cable receiving opening at a proximal end thereof and extending into a slotted cable receiving section. The secondary contact section includes a contact spring extending from and positioned adjacent to the wire contact section and a contact arm extending from the contact spring and extending to a contact point.

BRIEF DESCRIPTION OF THE DRAWINGS

The present invention will now be described by referring to a specific embodiment in combination with the drawing. In the drawing.

DETAILED DESCRIPTION OF THE EMBODIMENT(S)

Figure 1B:
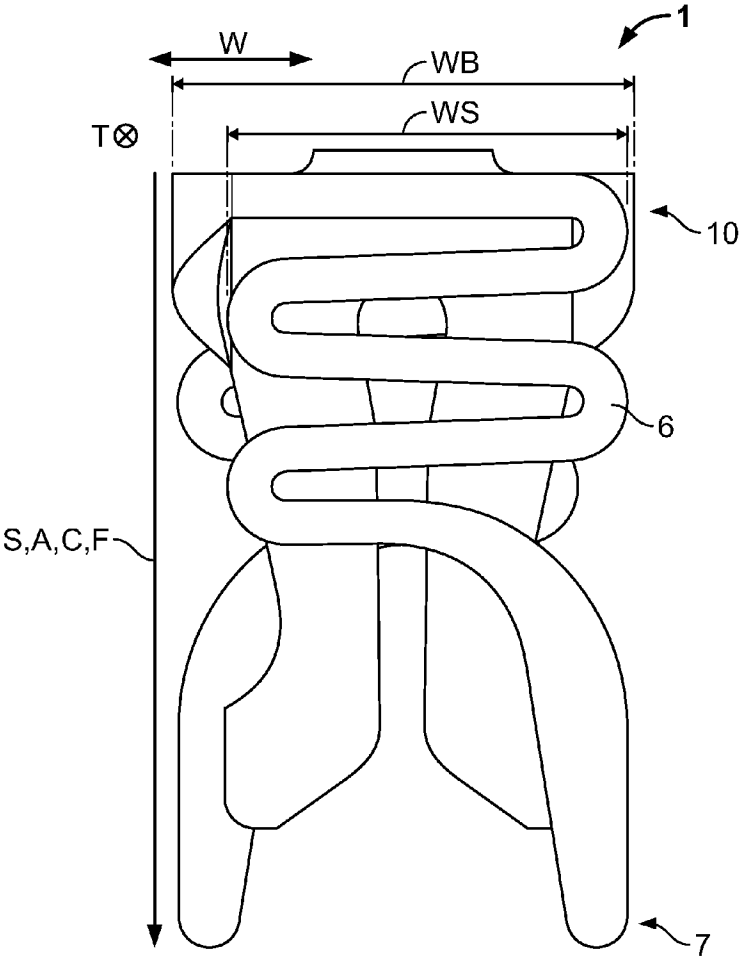
FIG. 1B shows a front view of the IDC contact according of FIG. 1A.

The invention will now be described hereinafter in greater detail and in an exemplary manner using advantageous embodiments and with reference to the drawings. The described embodiments are only possible configurations in which, however, the individual features as described above can be provided independently of one another or can be omitted in the drawings.

Figure 1A:
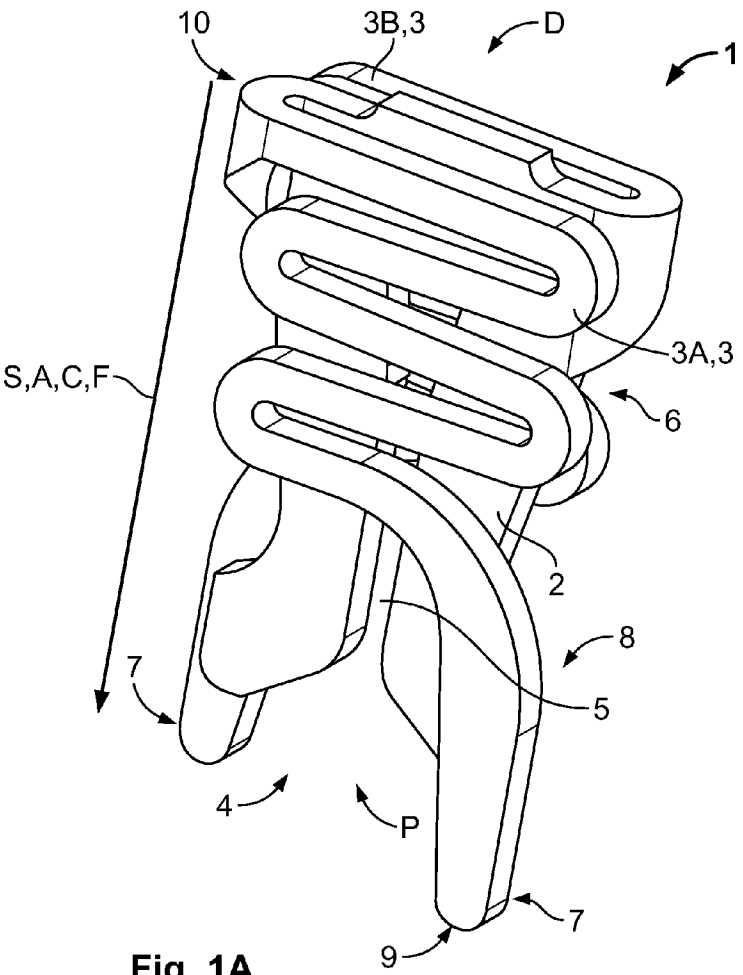
FIG. 1A shows a perspective view of an IDC contact according to the invention.

With reference to FIG. 1A, an IDC contact 1 according to the invention is depicted. The IDC contact 1 includes a wire contact section 2 and two secondary contact sections 3A, 3B. The wire contact section 2 includes a cable receiving opening 4 at a proximal end P of the IDC contact 1. A cable (not shown) having an insulator around a wire can be inserted into the cable receiving opening 4 of the IDC contact 1. By pushing the cable receiving opening 4 onto the cable, the cable receiving opening 4 will displace the insulation of the cable and make contact with the wire of the cable. The wire contact section 2 of the IDC contact 1 further includes a slotted cable receiving section 5, which helps to secure the cable in the IDC contact 1 during clamping. The slotted cable receiving section 5 ends in the cable receiving opening 4, which has the shape of a funnel in the shown embodiment. A narrow end of the funnel points to the slotted cable receiving section 5 in order to guide the cable into the slotted cable receiving section 5.

The secondary contact section 3A includes a contact spring 6, a contact point 7 and a contact arm 8, with the contact arm 8 terminating in the contact point 7. The contact spring 6 is disposed between the wire contact section 2 and the contact point 7. The contact spring 6 is compressible and extends in an actuation direction A that is parallel to a contact direction C of the IDC contact 1. The contact arm 8 runs parallel to the actuation direction A and the con-tact direction C, and terminates in the contact point 7. Thus, the contact point 7 has a well-defined, small contact area 9 that can contact an external element like a PCB.

The contact point 7 has a round shape, in order to avoid scratching or damaging the surface of the external element.

The contact point 7 and the opening of the wire contact section are both located at the proximal end P of the IDC contact 1. Therefore, the cable and the external element can make contact from the same end of the IDC contact 1, this end being the proximal end P. Such a design allows for a compact IDC contact 1 and, in particular, in the contact direction C, making the IDC contact 1 suitable for high frequency applications.

Both secondary contact sections 3A, 3B extend parallel to the slotted cable receiving section 5 of the wire contact section 2 and to the wire contact section 2 itself. Forces that are exerted for example by the cable onto the wire contact section 2 are usually parallel to the slotted cable receiving section 5 and thus also parallel to the secondary contact sections 3A, 3B.

The secondary contact sections 3A, 3B also extend alongside the cable receiving opening 4 and the slotted cable receiving section 5. This proximity is advantageous, as the force exerted onto the wire contact section 2 is then much like the force exerted onto the secondary contact sections 3A, 3B, which can prevent an internal deformation of the IDC contact 1.

The contact arm 8 is a lever directed in a direction S of the slotted cable receiving section 5. The contact arm 8 is stiff along the contact direction C. Therefore, any contact force F exerted by the contact spring 6 onto the contact point 7 can be adjusted by adjusting the properties of the contact spring 6, for example the spring constant or the length or width of the contact spring 6 in order to compensate different lengths of the contact spring 6. In the actuation direction A of the contact spring 6, the contact arm 8 can have different lengths.

A contact point 7, which may be a protrusion, helps to clearly define the contact area 9 between the secondary contact section 3A and the external element. In particular, it can avoid unwanted contact of the contact spring 6 to an external element by giving a well-defined contact area at which the secondary contact section 3A can contact the external element away from the contact spring 6 and which can only be deflected in an actuation direction S of the contact spring 6. Here, the actuation direction A is identical to the contact direction C.

The wire contact section 2 is connected to the secondary contact sections 3A, 3B along a base portion 10. However, the connection might also be located at a top portion; it might for example be located at a distal end D of the IDC contact 1.

The base portion 10 is located at the distal end D of the IDC contact 1. Therefore, the actuation length of the contact spring 6 is maximized. Furthermore, a force can be exerted on the distal end D of the IDC contact 1 in order to push the wire contact section 2 over the cable and contact the external element with the secondary contact sections 3A, 3B at the same time, the external element and the cable both being located at the proximal end P of the IDC contact 1.

The IDC contact 1 as shown includes two secondary contact sections 3A, 3B, located on opposite sides of the wire contact section 2. During operation, both secondary contact sections 3A, 3B can contact an external element, which leads to an equal force distribution and avoids a tilting of the IDC contact 1. In particular, the cable receiving opening 4 is located between the contact points 7 of the secondary contact sections 3A, 3B.

The secondary contact sections 3A, 3B and the wire contact section 2 are planar, which gives the IDC contact 1 a compact design. Furthermore, the planes of the secondary contact sections 3A, 3B are parallel to the plane of the wire contact section 2, giving the IDC contact 1 a layer-like design. Such a slim embodiment has good high-frequency properties, making the IDC contact 1 suitable for high transfer rates if used for signal transmission.

The two secondary contact sections 3A and 3B are identical and axially symmetric around an axis running through the slotted cable receiving section 5. Such an axially symmetric design makes manufacturing of the IDC contact easy. Furthermore, such a symmetric design improves the high-frequency signal transmission properties of the IDC contact 1.

As shown in FIG. 1B, the IDC contact, a width of the spring WS is smaller than the width of the base portion WB. Such a design allows the contact spring 6 to move freely once the IDC contact 1 is inserted into a cavity of an electrical plug.

The contact spring 6 as shown has a zigzag or meander-like shape. However, a contact spring 6 could be bow-like or have any other design that allows for a movement of the contact point 7 in the contact direction C. In other words, the actuation direction A of the contact spring 6 should be parallel to the contact direction C.

Figure 1C:
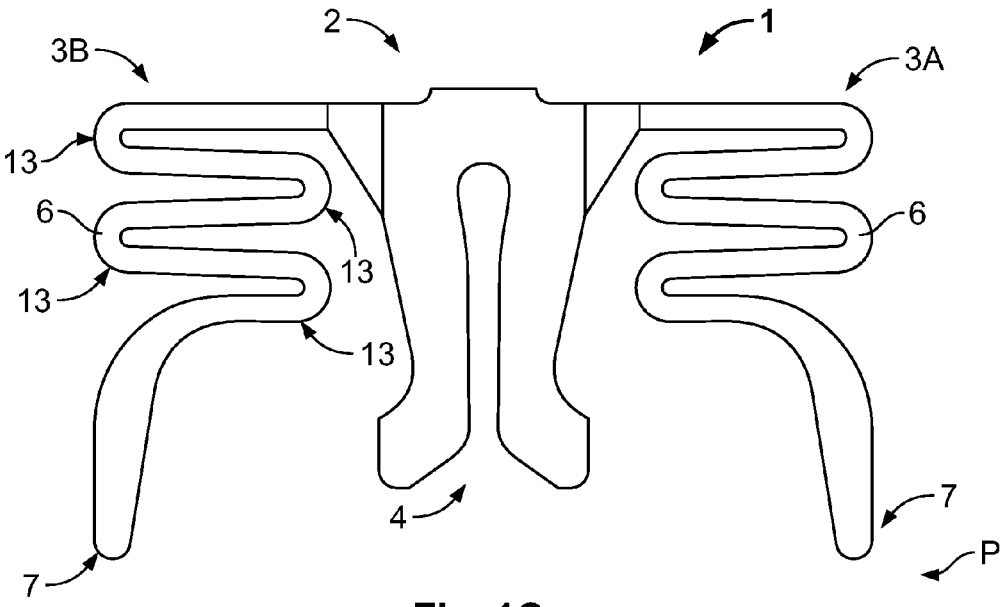
FIG. 1C shows a front view of the IDC contact according to FIG. 1A prior final assembly.

Now with reference to FIG. 1C, the IDC contact 1 is shown before final assembly. The IDC contact 1 has been cut out or punched out of a metal sheet and is still planar. In a subsequent step, the secondary contact sections 3A and 3B will be folded back onto the wire contact section 2 on opposite sides of the wire contact section 2.

The IDC contact 1 shown in FIG. 1C has all the features of a finished IDC contact 1 according to the invention. Each contact points 7 of a secondary contact section 3 is located on the proximal end P on which the opening of the wire contact section 2 is also located. Further, the contact spring 6 is situated between the contact point 7 and the wire contact section 2. Therefore, the IDC contact 1 as shown can also be used with a suitable cavity of an electrical plug.

Each of the contact springs 6 includes four bends 13. In this case, the bends 13 were made by punching. In another embodiment, those bends could be made by bending a metal sheet mechanically. However, producing the bends 13 by punching is easier and less time- and cost-consuming. It only includes the step of punching.

Figure 2A:
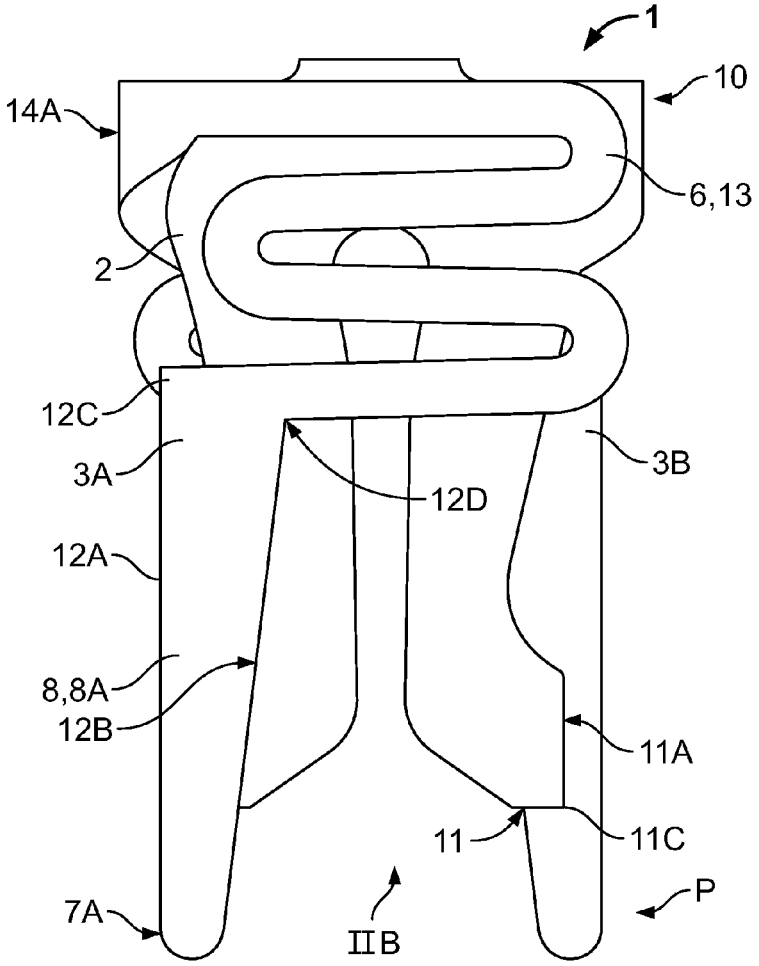
FIG. 2A shows a front view of another IDC contact according to the invention.

Now with reference to FIG. 2A, another IDC contact 1 according to the invention is shown. Similar to the embodiment of FIGS. 1A to C, the embodiment as shown also has one wire contact section 2 and two secondary contact sections 3A, 3B. The IDC contact 1 as shown in FIG. 2A is, however, simpler in its design. Two edges 11A, 11B of the wire contact section 2 are straight, resulting in a sharp corner 11C of the wire contact section on its proximal end P. Furthermore, two edges 12A, 12B of the contact arm 8 are also straight, leading to corners 12C, 12D in the transition area between the contact arm 8 and the contact spring 6. Straight edges can be manufactured more easily, which reduces the overall price of the IDC contact 1. However, sharp corners might be disadvantageous for high frequency applications and round corners might be preferred.

Figure 2B:
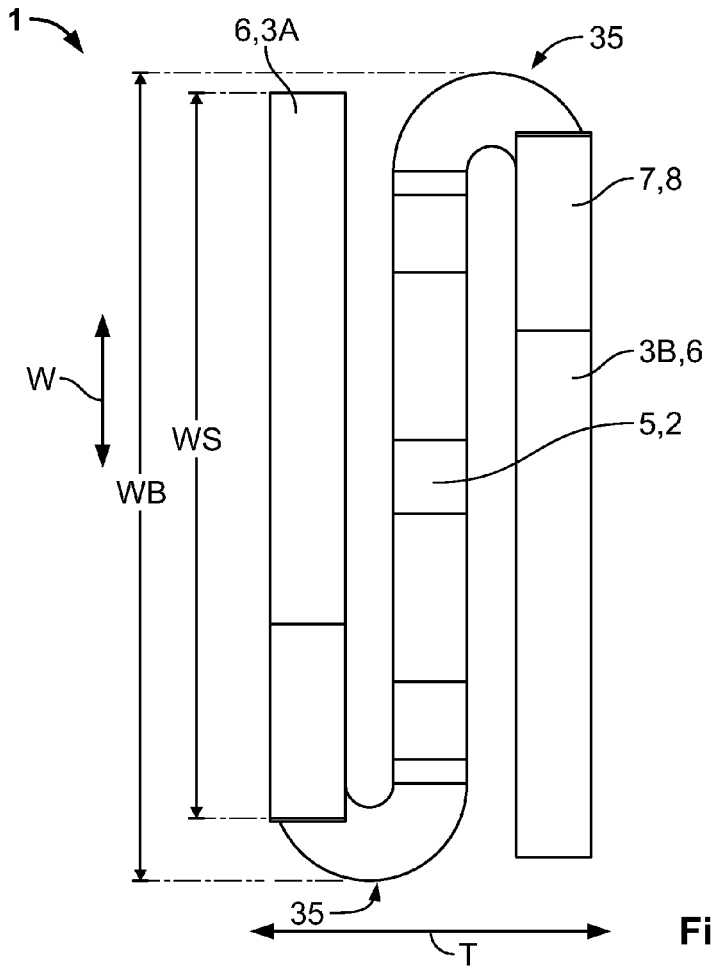
FIG. 2B shows a top view of the IDC contact of FIG. 2A.

A further difference to the design of the IDC contact of FIGS. 1A to C is that the IDC contact 1 as shown includes a contact spring 6 with only three bends 13. Consequently, the contact point 7A and the contact arm 8A of the secondary contact section 3A are located on the same side of the IDC contact at a connection area 14A connecting the wire contact section 2 with the secondary contact section 3A. In this front view all three are located on the left hand side. FIG. 2B shows the IDC contact of FIG. 2A in a view from the proximal end P in the direction MB of FIG. 2A. However, in this view, the IDC contact 1 has an S-like shape, the secondary contact sections 3A, 3B being the ends and the wire contact section 2 being the center of the S. The contact springs 6 are in their relaxed state. Therefore, the wire contact section 2 does not contact the secondary contact sections 3A, 3B. Like in the shown embodiment of FIGS. 1A through C, the wire contact section 2 and the secondary contact sections 3A, 3B are planar and parallel to each other. The IDC contact 1 was made by cutting and bending a metal sheet, in particular by bending the metal sheet piece back onto itself by 180 degrees. This results in a very compact design of the IDC contact 1, in particular in a stacking direction T.

From this perspective, it can also be seen that in a width direction W, the width of the contact spring WS is smaller than the width of the base portion WB so that the spring can move freely once it is inserted into a cavity of an electrical plug.

Each of the contact springs 6 includes a turn 35 by which the contact spring 6 is attached to the wire contact section 2. Those turns 35 were made by bending.

Figure 2C:
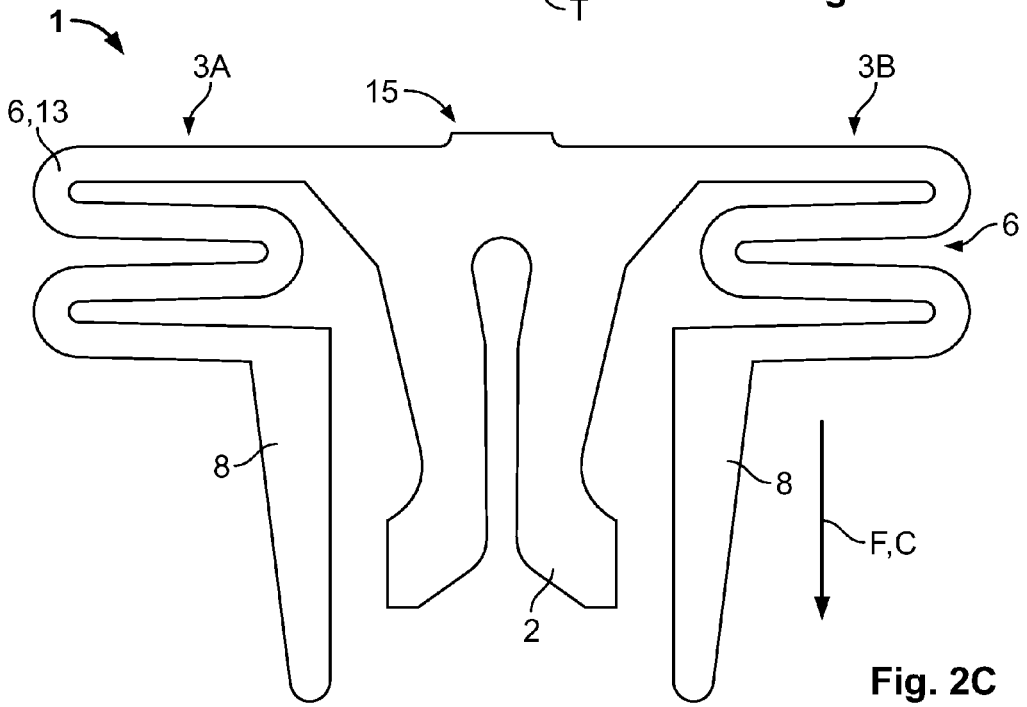
FIG. 2C shows a front view of the IDC contact of FIG. 2A prior to final assembly.

Now with reference to FIG. 2C, an IDC contact 1 of FIGS. 2A and 2B is shown prior to final assembly. This front perspective view depicts the metal sheet piece that was punched or cut out of a metal sheet and can be folded or bent in the shape of the IDC contact 1 of FIGS. 2A and 2B. However, the IDC contact 1 as shown could also be used in a suitable cavity of an electrical plug without further processing.

Each secondary contact section 3A, 3B of the IDC contact 1 as shown has a contact spring 6 having three bends 13 in contrast to the contact spring 6 of FIGS. 1A to 1C which has four bends 13. Accordingly, the contact arms 8 are located more closely to the wire contact section 2. In a very simple design, a contact spring 6 can have only one bend 13. In another embodiment, the meander-like or zigzag-like shape of the contact spring 6 could be replaced by a different design, for example a bow-like design or any other design that results in a spring force F in the contact direction C.

An IDC contact 1 according to the invention can also include a retaining mechanism 15 that secures the IDC contact in a counter part in the cavity of an electrical plug. However, the retaining mechanism 15 can also only be due to the manufacturing process in which the retaining mechanism 15 serves to hold the semi-finished IDC contact 1 on a strip of metal in order to make handling easy. FIG. 3A shows the IDC contact of FIGS. 1A to C in a front perspective view of a section through an electrical plug 16 that holds the IDC contact 1 in one of its cavities 17. An external force E pushes a moveable section 16A of the electrical plug 16 into a fixed part 16B of the electrical plug 16, forcing the IDC contact 1, in particular the wire contact section 2 over a cable 18 having a wire 19 in its center.

Figure 3B:
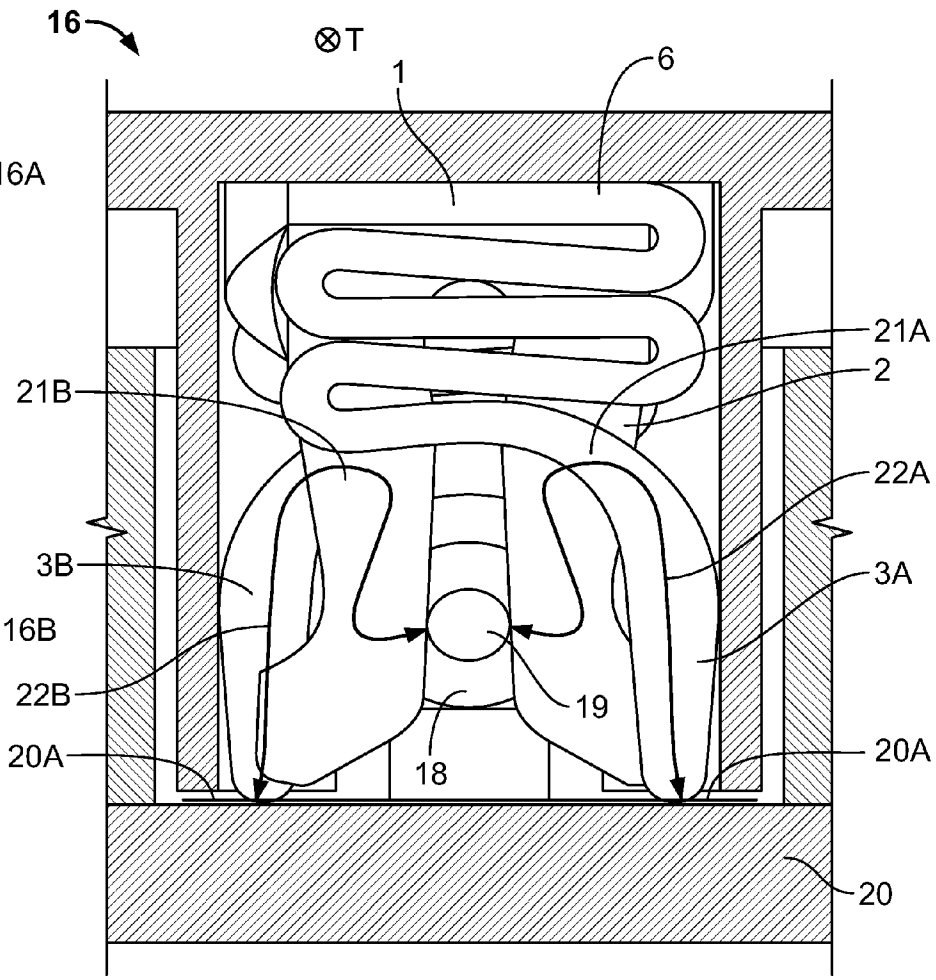
FIG. 3B shows another front view of the embodiment of the IDC contact according to FIG. 1A disposed in an electrical plug.
Figure 3A:
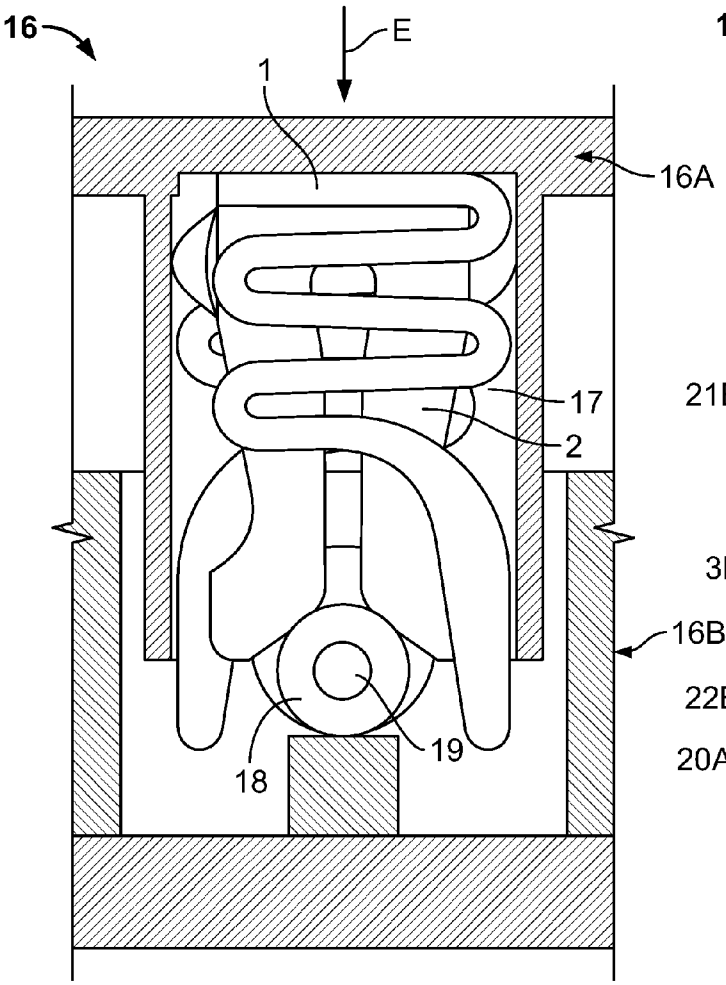
FIG. 3A shows a front view of the IDC contact according to FIG. 1A disposed in an electrical plug.

As shown in FIG. 3B, the IDC contact 1 has been pushed over the cable 18 and the wire contact section 2 now contacts the wire 19 of the cable 18. Furthermore, the secondary contact sections 3A, 3B contact the external element 20 at a contact pad 20A.

The contact spring 6 is now in a compressed and displaced position in which the contact spring is also displaced in the stacking direction T. Therefore, the secondary contact sections 3A, 3B touch the wire contact sections at bypass locations 21A, 21B so that the current coming from the wire 19 runs through part of the wire contact section 2 and through the bypass location 21A and 21B to the secondary contact sections 3A, 3B and subsequently to the external element 20. This leads to a very short current path and thus to a good signal quality of the current. Possible current paths 22A, 22B are indicated by the arrows.

Figure 4:
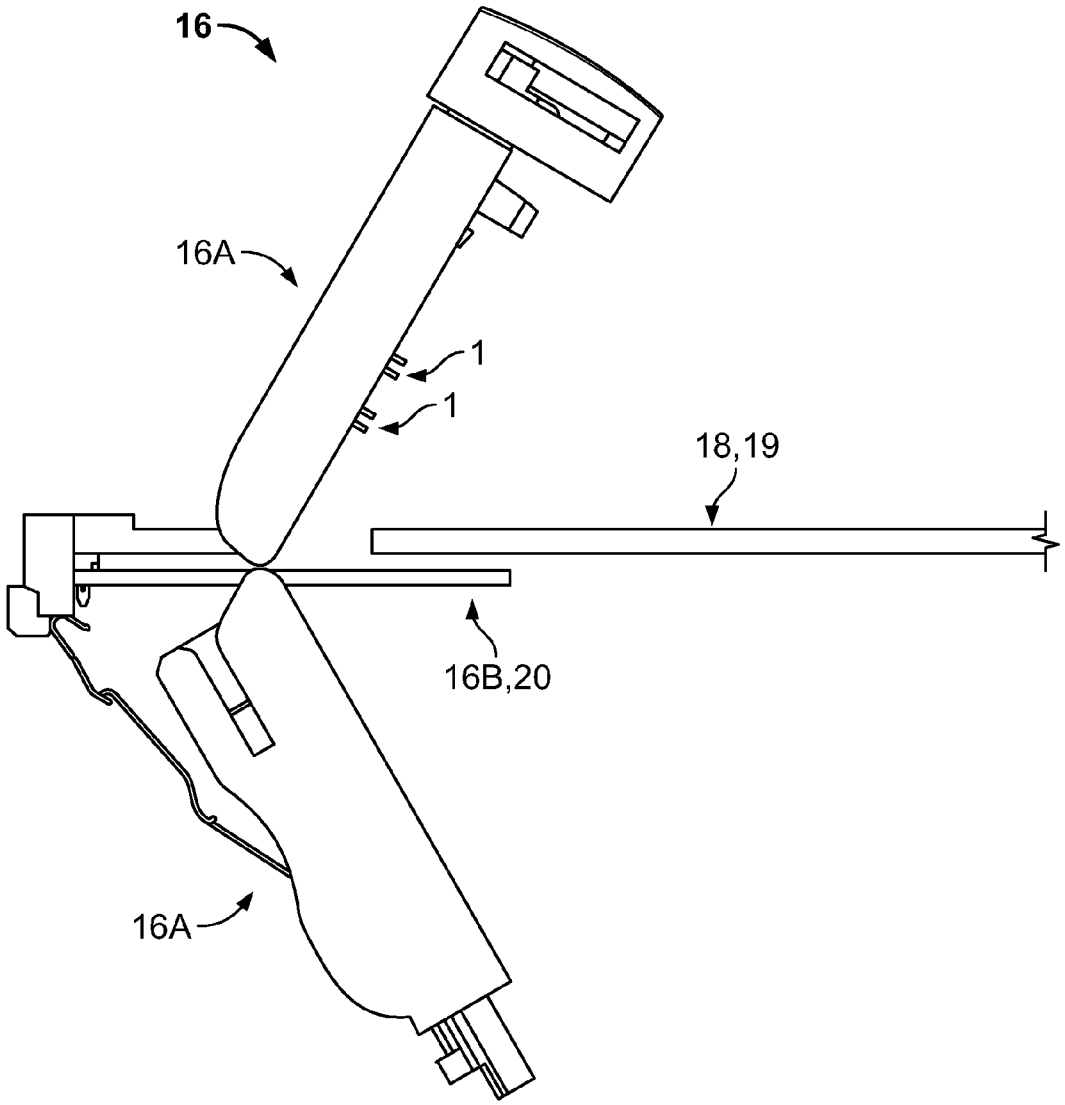
FIG. 4 shows a side view of an electrical plug having a pair of IDC contacts according to the invention.

Now with reference to FIG. 4, an electrical plug 16 is shown and includes IDC contacts 1 according to the invention. The cable clamping electrical plug 16 shown includes two moveable sections 16A that can be folded onto a fixed part 16B, clamping a cable 18 located between the moveable sections 16A and the fixed part 16B in order to make an electrical contact between the wire 19 of the cable 18 and the external element 20 located on the fixed part 16B of the electrical plug 16.

Figure 5:
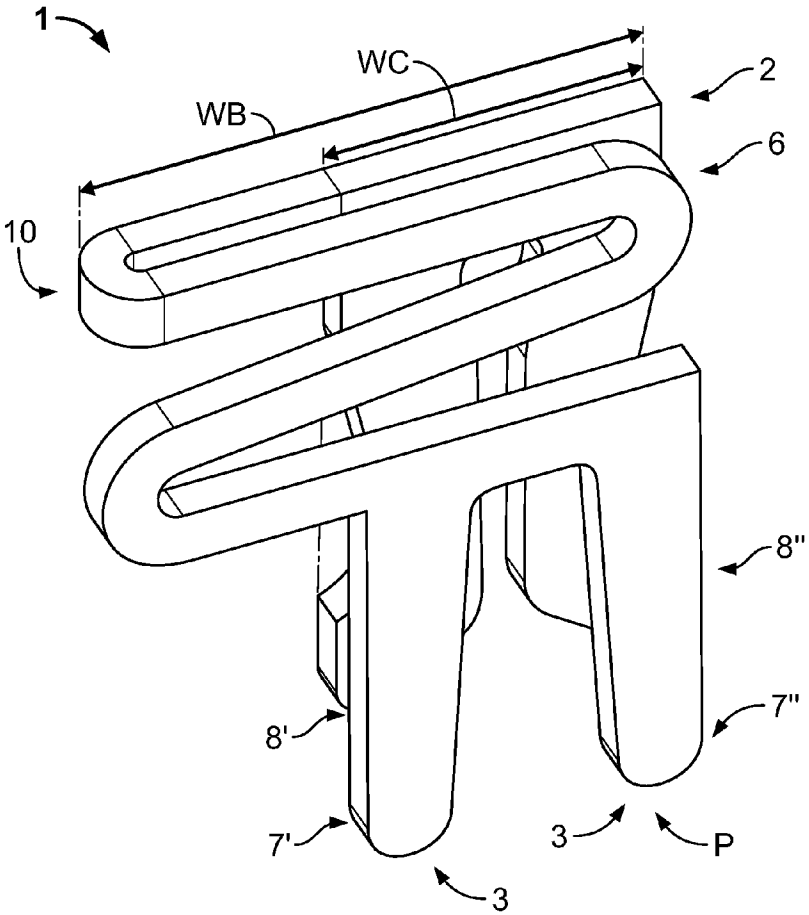
FIG. 5 shows a perspective view of another IDC contact according to the invention.

With reference to FIG. 5, another IDC contact according to the invention is shown. The wire contact section 2 is connected at a base portion 10 to the contact spring 6. The contact spring 6 is further connected to the secondary contact section 3 and thus located between the secondary contact section 3 and the wire contact section 2.

The secondary contact section 3 includes two contact arms 8', 8". The first contact arm 8' and the second contact arm 8" each comprise a separate contact point 7', 7" located on the proximal end P of the IDC contact 1. Each of the contact arms 8', 8" can serve as a backup for the other contact arm 8", 8' resulting in a higher reliability of the contact of the IDC contact 1 to the external element. During operation, a cable (not shown) can be located between the two contact arms 8', 8". In order to ensure that the secondary contact section 3 is moveable, direct contact between the cable and the contact arms 8', 8" is not intended.

The width WB of the base portion is much greater than the width WC of the wire contact section at the proximal end P. An IDC contact 1 with such a design can be inserted into a wide cavity and be held in the cavity at the base portion 10. Furthermore, in this design the contact spring 6 can be much wider and thus softer. In the embodiment as shown the width WB of the base portion is about 1.8 times the width WC of the contact section 2.

Figure 6:
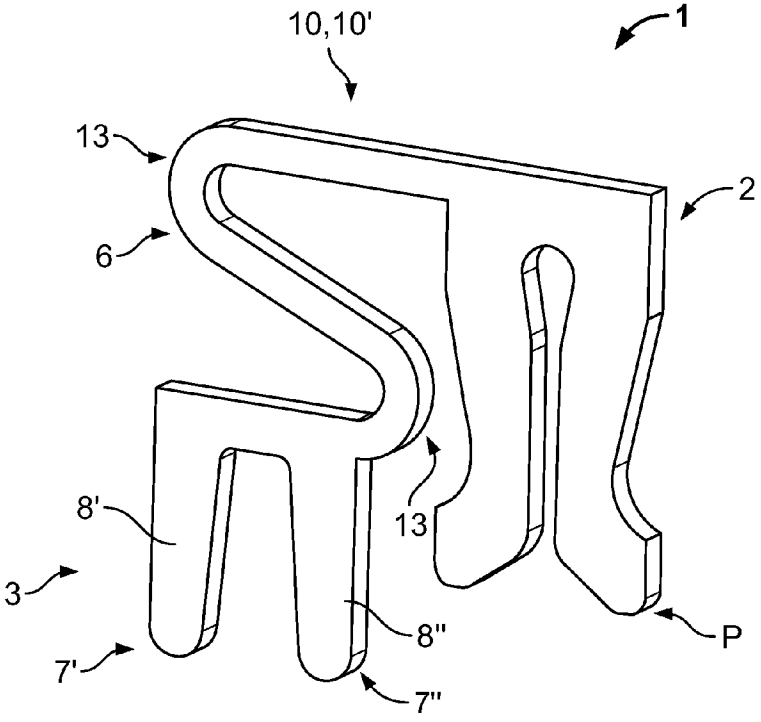
FIG. 6 shows a perspective view of another IDC contact according to the invention.

With reference to FIG. 6, another IDC contact 1 according to the invention is depicted. The entire IDC contact 1 is planar. The wire contact section 2 and the secondary contact section 3 are each planar and lie in the same plane.

The contact spring 6 is located between the wire contact section 2 and the secondary contact section 3. The contact spring 6 has two bends 13.

The base portion 10 as shown is an extended base portion 10' that extends in the plane of the IDC contact 1. The extended base portion 10' is directly connected to the contact spring 6 at one of the bends 13 of the contact spring 6.

The wire contact section 2 and the secondary contact section 3 are arranged side by side. This arrangement allows the IDC contact 1 to be very flat.

Figure 7:
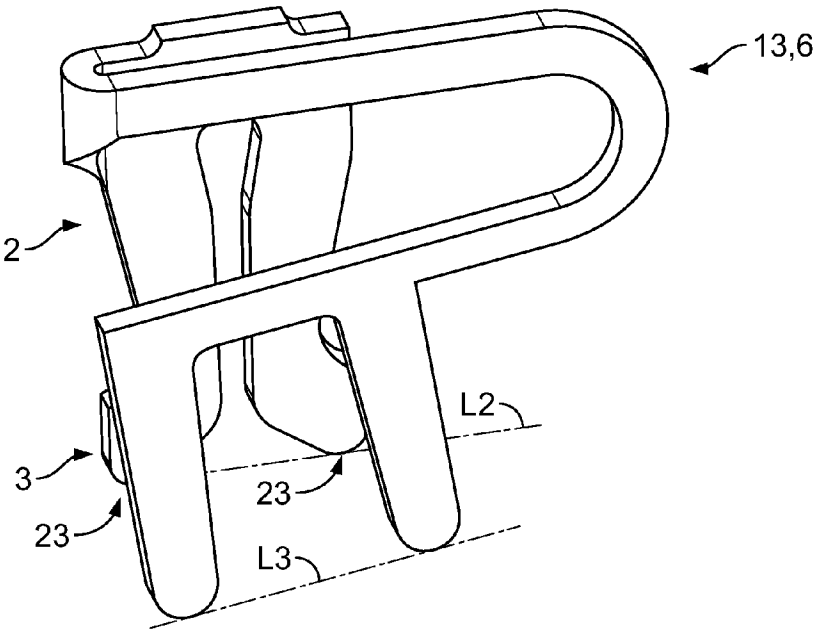
FIG. 7 shows a perspective view of another IDC contact according to the invention.

With reference to FIG. 7, the IDC contact 1 according to the invention is shown. The IDC contact 1 has a contact spring 6 with only one bend 13. During operation the secondary contact section 3 will be pushed towards the distal end D of the IDC contact 1. This movement leads to a rotation of the secondary contact section 3 relative to the bend 13. In order to compensate this rotation, a line L3 connecting the contact points 7', 7" of the contact arms 8', 8" is tilted relative to a line connecting the ends 23 of the wire contact section 2. The line L3 is at an angle relative to the line L2.

Figure 8:
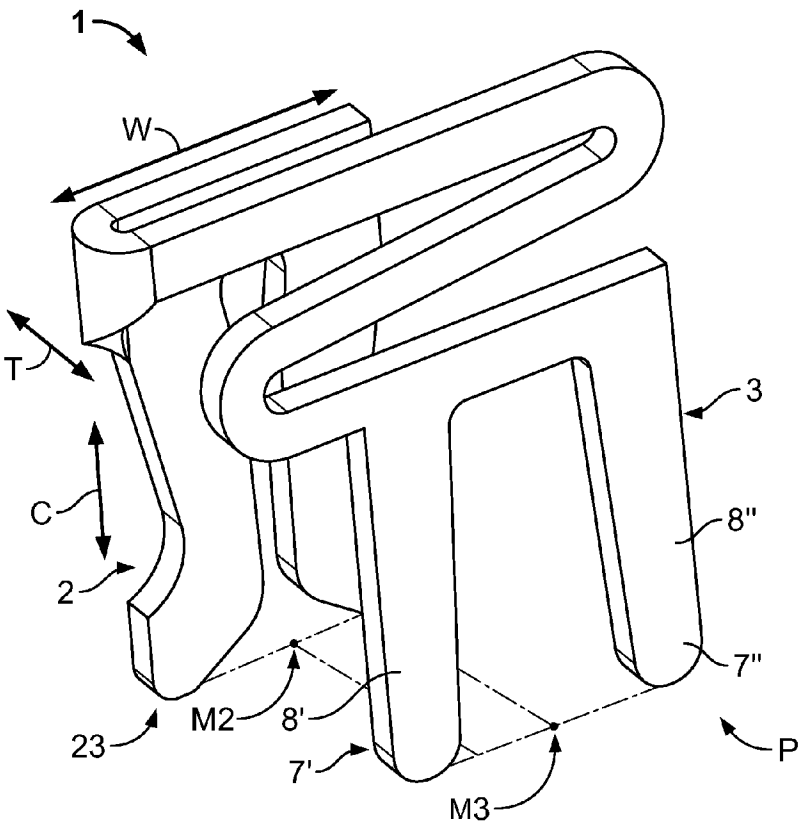
FIG. 8 shows a perspective view of another IDC contact according to the invention.

With reference to FIG. 8, another IDC contact 1 according to the invention is depicted. The wire contact section 2 and the secondary contact section 3 are stacked in a stacking direction T. The stacking direction T is perpendicular to the width direction W and the contact direction C.

The central point M2 lying in the middle of the two ends 23 of the wire contact section 2 is offset in the width direction W relative to the central point M3 which is located in the middle of the two contact points 7', 7" of the two contact arms 8', 8". The contact points 7, 7" can thus contact counter contacts that are not symmetric around the cable (not shown).

Figure 9:
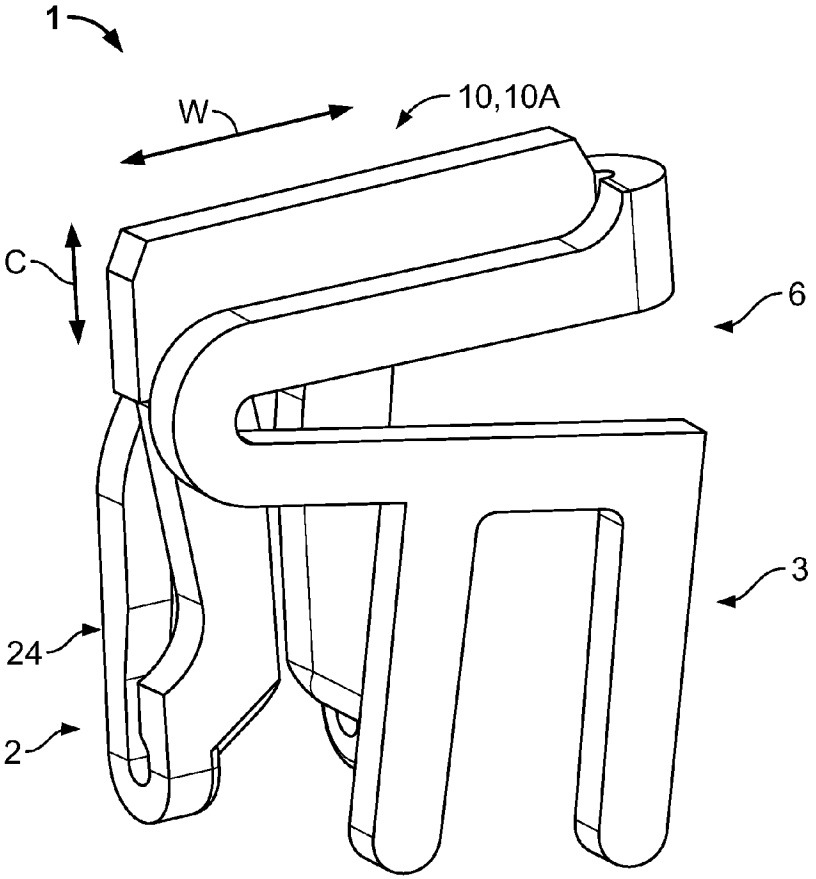
FIG. 9 shows a perspective view of another IDC contact according to the invention.

With reference to FIG. 9, another IDC contact 1 according to the invention is shown. The IDC contact 1 again includes a wire contact section 2, a secondary contact section 3 and a contact spring 6 located between the wire contact section 2 and the secondary contact section 3.

The IDC contact 1 further includes a backup spring 24. The backup spring 24 serves to enhance the spring force of the wire contact section 2. Thereby, thicker insulations can be displaced as higher pushing forces can be exerted. The backup spring 24 has a horseshoe-like design. The backup spring 24 as shown has been created by folding over the metal sheet from which the entire IDC contact 1 is made. Thus, the IDC contact 1 consists of only one piece.

The IDC contact 1 of the shown embodiment has a reinforced base portion 10A that is wider in the width direction W than other base portions 10 shown in further embodiments in other figures. The reinforced base portion 10*a* is also higher in a contact direction C than the other embodiments shown here. This enhances the stability of the IDC contact 1 further.

Figure 10:
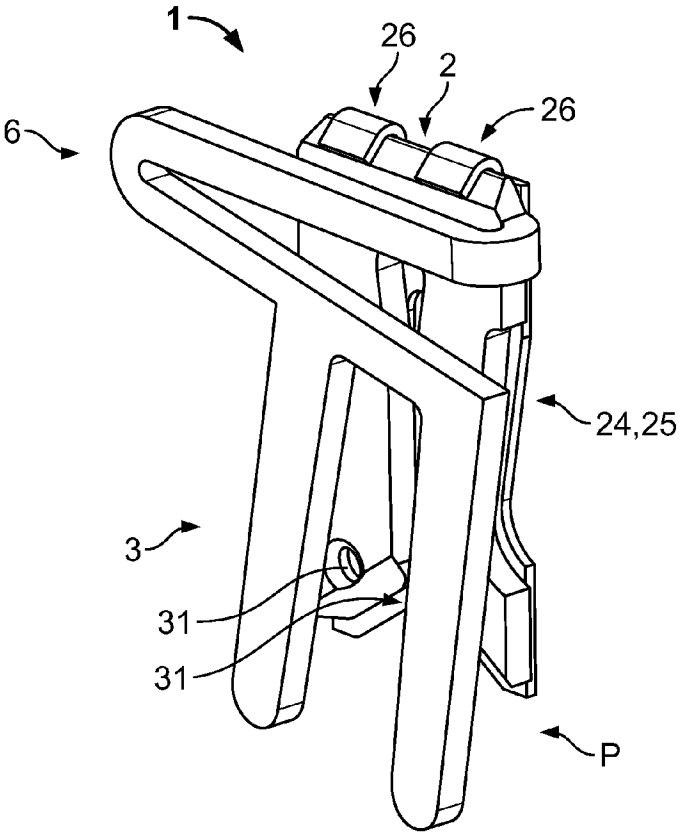
FIG. 10 shows a perspective view of another IDC contact according to the invention.

With reference to FIG. 10, another IDC contact 1 is shown. This IDC contact 1 includes a backup spring 24 in the form of a separate backup spring 25. The separate backup spring 25 can be attached loosely to the wire contact section 2. The separate backup spring 25 can also be attached permanently to the wire contact section 2, for example by welding or gluing. The separate backup spring 25 can serve to enhance the stability of the wire contact section 2. It can also serve to increase the contact force exerted by the wire contact section 2. Two securing pieces 26 secure the separate backup spring 25 to the wire contact section 2. In order to attach the backup spring 24 to the wire contact section 2, the wire contact section 2 has holes 31 at the proximal end P. Corresponding fastener pins of the backup spring 24 can engage with these holes in order to secure the backup spring 24 to the wire contact section 2. However, in the shown embodiment the backup spring 24 does not have fastener pins.

Figure 11:
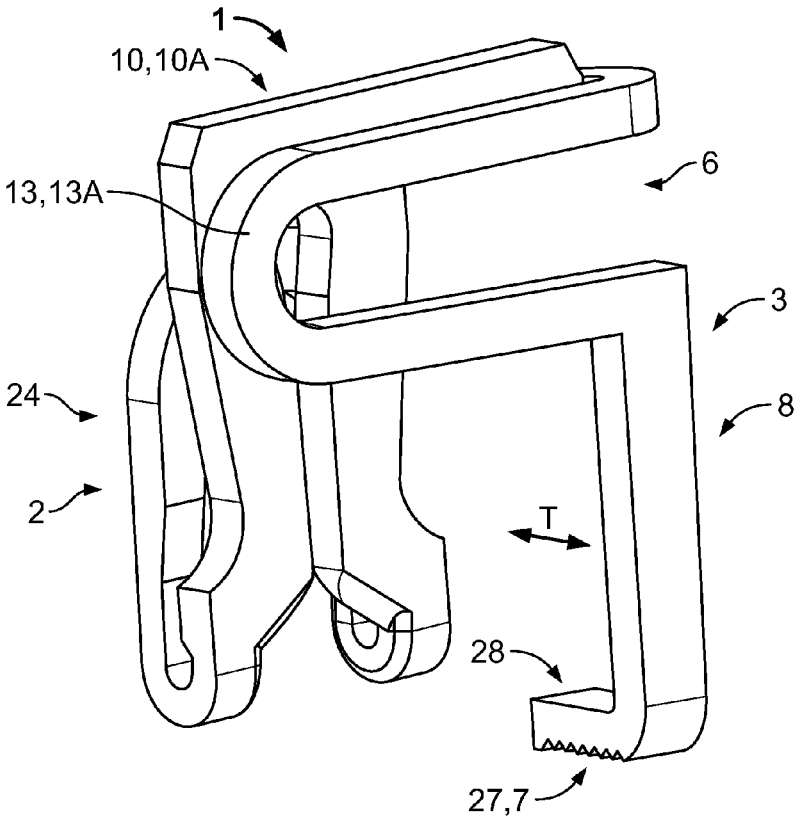
FIG. 11 shows a perspective view of another IDC contact according to the invention.

With respect to FIG. 11, another IDC contact 1 is shown. The IDC contact 1 includes a backup spring 24 that is integral or unitary with the rest of the IDC contact 1.

The base portion 10 of the shown embodiment is a reinforced base portion 10A.

The contact spring 6 has only one bend 13 in the form of a horseshoe-like bend 13A. The secondary contact section 3 includes a contact arm 8 with a contact point 7. The contact point 7 shown herein is a riffled contact point 27. The contact arm 8 is bent towards the wire contact section 2 at an end section 28 of the contact arm 8 and points in the stacking direction T.

Figure 12:
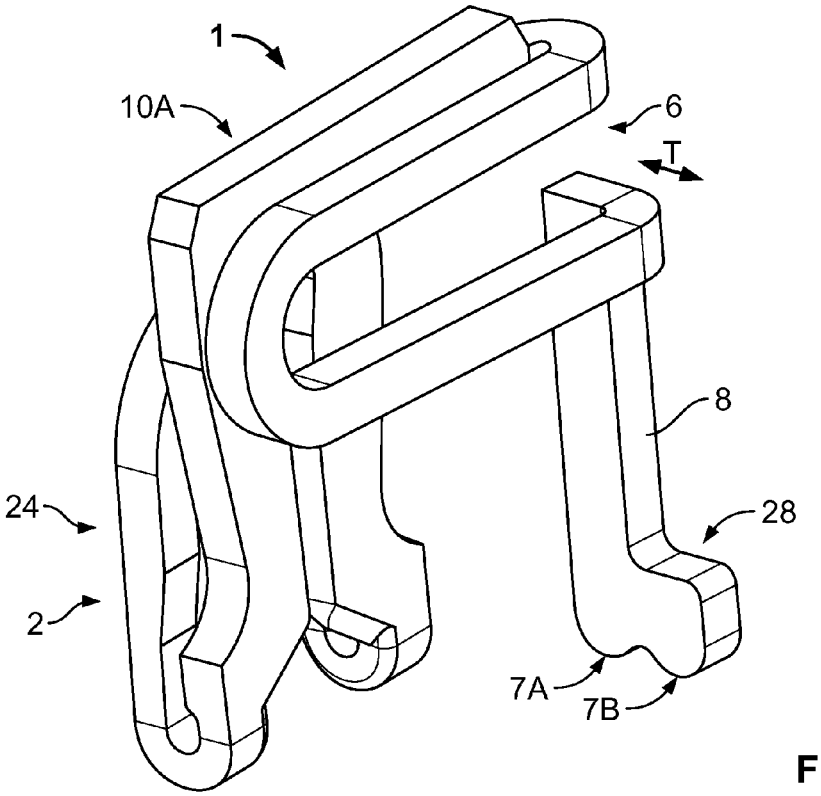
FIG. 12 shows a perspective view of another IDC contact according to the invention.

With respect to FIG. 12, another IDC contact 1 is shown. The IDC contact 1 again includes a backup spring 24 at the wire contact section 2, a reinforced base portion 10A, a contact spring 6 and a contact arm 8 located at the end of the contact spring 6. At an end section 28 of the contact arm 8 two contact points 7A, 7B are located. The end section 28 of the contact arm 8 extends in the stacking direction T. The two contact points 7A, 7B are located behind each other in the stacking direction T. The spring force of the contact spring 6 is thus distributed equally to the two contact points 7A, 7B.

Figure 13:
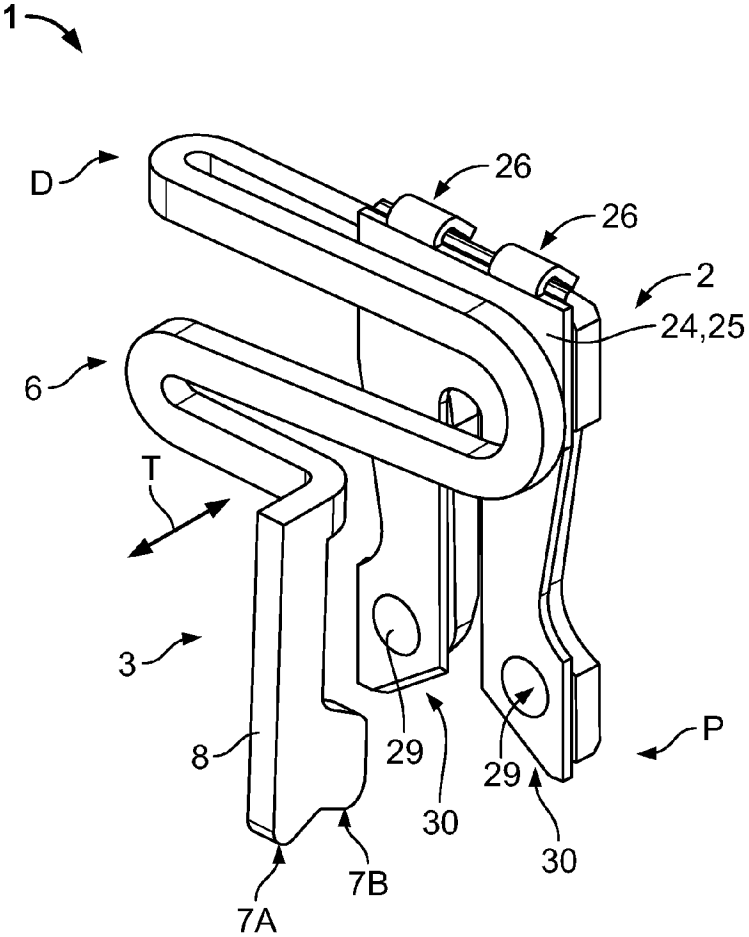
FIG. 13 shows a perspective view of another IDC contact according to the invention.

With respect to FIG. 13, another IDC contact 1 is depicted. The shown embodiment has two contact points 7A, 7B located at a contact arm 8 of the secondary contact section 3. The two contact points 7A, 7B lie behind each other in the stacking direction T of the IDC contact 1.

Further, a backup spring 24 in the form of a separate backup spring 25 is attached to the wire contact section 2 with two securing pieces 26 at the distal end D of the IDC contact 1 and two fastener pins 29 located at the proximal end P of the backup spring 24. The fastener pins 29 engage with holes in the wire contact section 2 and thus secure the backup spring 24 to the wire contact section 2.

The backup spring 24 includes bladelike edges 30 located on the proximal end P of the backup spring 24 which help to displace the insulation of a cable.

Figure 14:
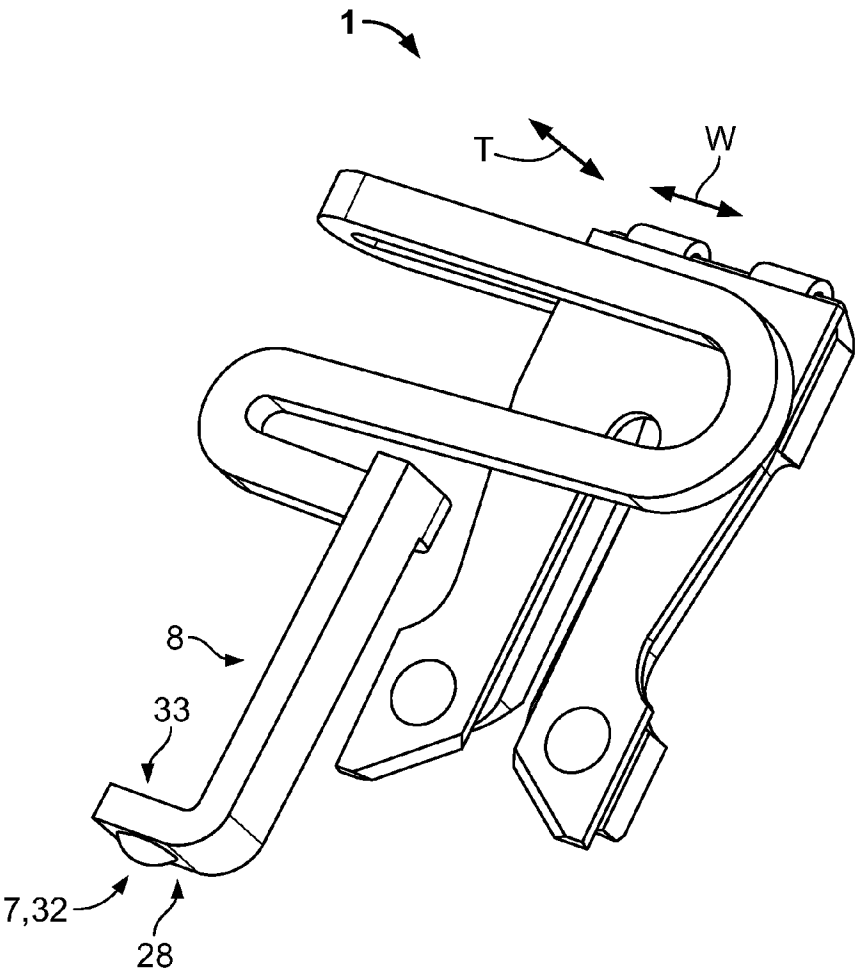
FIG. 14 shows a perspective view of another an IDC contact according to the invention.

With respect to FIG. 14, another IDC contact 1 is shown. A contact arm 8 of the shown embodiment has a punched contact point 32. The punched contact point 32 has been made by pushing onto the upper side 33 of the end section 28 of the contact arm 8. The punched contact point 32 has a shape that resembles a section of a sphere. Therefore, it can easily be moved in the width direction W and the stacking direction T without damaging the external element that is contacted.

The end section 28 of the contact arm 8 is bent and points in the width direction W.

Figure 15:
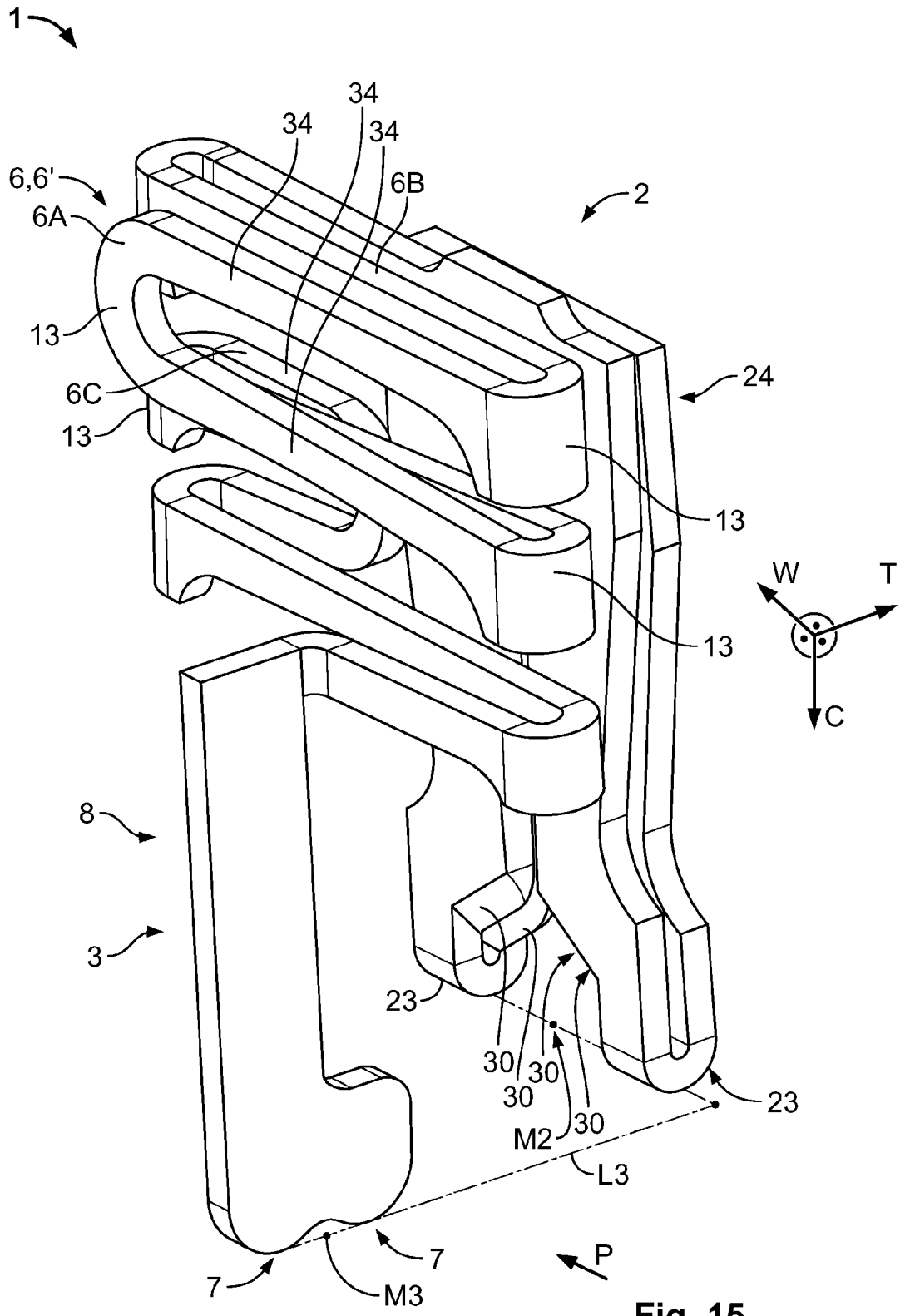
FIG. 15 shows a perspective view of another IDC contact according to the invention.

With respect to FIG. 15, another IDC contact 1 is depicted. The wire contact section 2 includes a backup spring 24. The backup spring 24 is integral with the wire contact section 2 and has been manufactured by bending or folding.

The wire contact section 2 and the backup spring 24 each have bladelike elements 30 located at the proximal end P in order to displace the insulation of a cable.

The secondary contact section 3 has two contact points 7 located at the proximal end P of the contact arm 8. The two contact points 7 are located behind each other in the second direction T and serve as a backup for each other. Each of the contact points 7 is rounded in the stacking direction T in order to minimize the damage to the external element if relative movements between the external element and the IDC contacts 1 occur.

The contact spring 6 is located between the wire contact section 2 and the secondary contact section 3. The contact spring 6 is a layered contact spring 6'. The contact spring 6 as shown has a first layer 6A, a second layer 6B and a third layer 6C which are layered in the stacking direction T of the IDC contact 1. This allows for a more compact and lighter design of the IDC contact 1 as a thinner metal sheet can be used. Furthermore, a spring force of the contact spring 6 can be softer.

The contact spring 6 has straight sections 34 running in the width direction W. Some of the straight sections 34 have a cross section that is smaller than the corresponding bends 13. Accordingly, the spring is softer and more flexible.

The line L3 connecting the two contact points 7 is offset in the width direction W relative to the central point M2 between the ends 23 of the wire contact section 2. Such a design allows contacting the wire of the cable with the wire contact section 2 and a counter contact area of the external element when the cable runs perpendicular to the wire contact section 2. Accordingly, the central point M3 between the two contact points 7 is also offset in a width direction relative to the central point between the ends 23 of the wire contact section.

Figure 16:
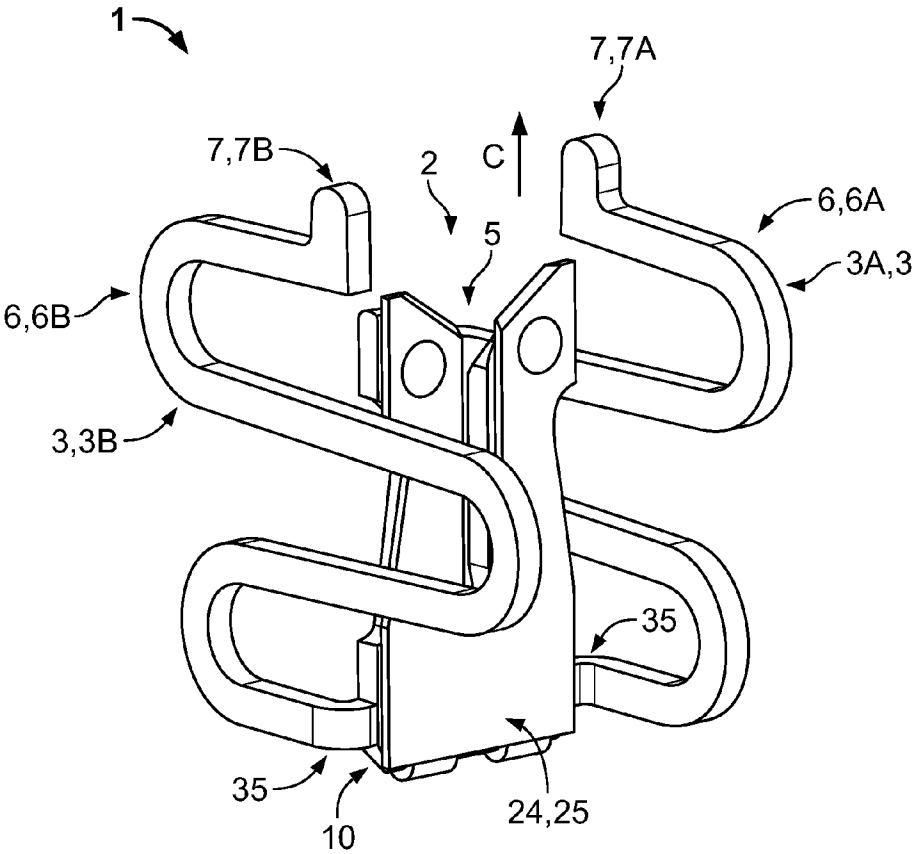
FIG. 16 shows a perspective view of another IDC contact according to the invention.

A IDC contact 1 shown in FIG. 16 includes a wire contact section 2 with a slotted cable receiving section 5 and two secondary contact sections 3, 3A, 3B, each of which has a contact point 7, 7A, 7B. Each secondary contact section includes a contact spring 6, 6A, 6B. The first contact spring 6A is oriented in the opposite direction to the second contact spring 6B.

The contact springs 6 run parallel to the slotted cable receiving section 5 but not parallel to the wire contact section 2. Rather, the planes of the contact springs 6 run perpendicular to the plane of the wire contact section 2. However, the contact direction C of the contact springs 6 is parallel to the plane of the wire contact section 2. Each of the contact springs 6 includes a turn 35 that is connected to the base portion 10. The turn 35 has been produced by bending and serves to orient the contact springs 6 perpendicular to the wire contact section 2.

The wire contact section 2 is reinforced by a backup spring 24 in the form of a separate backup spring 25 that is attached to the wire contact section 2.

Figure 17:
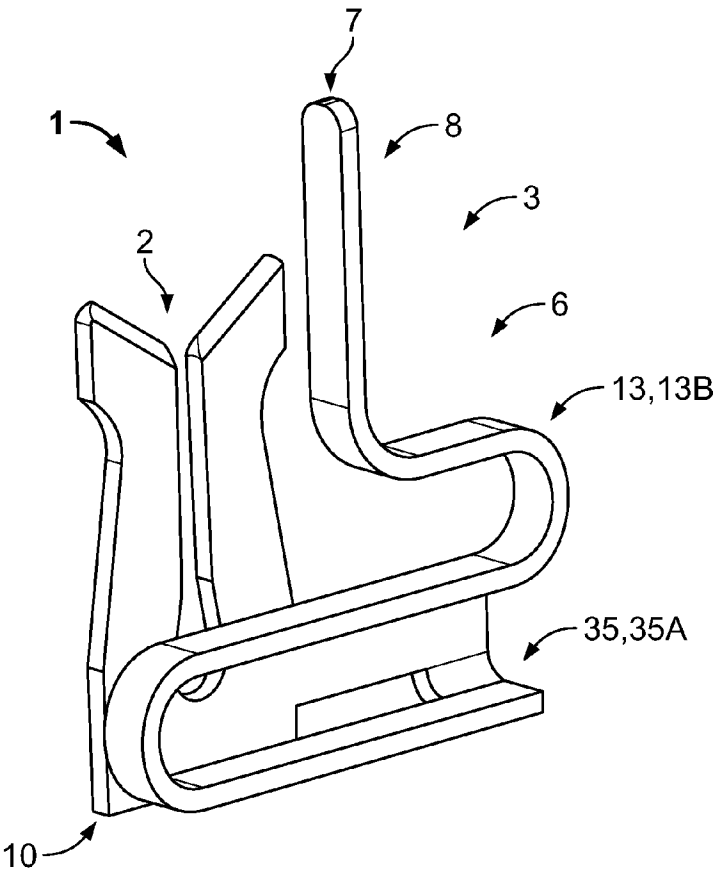
FIG. 17 shows a perspective view of another IDC contact according to the invention.

With respect to FIG. 17, another IDC contact 1 according to the invention is depicted. The IDC contact 1 again includes a wire contact section 2 and a secondary contact section 3. The secondary contact section 3 includes a contact point 7 at the end of a contact arm 8 that is attached to a contact spring 6. The contact spring 6 includes two bends 13, which are formed mechanically by bending and thus are bends 13B formed by bending. The contact spring 6 is connected to the wire contact section 2 at a base portion 10. The entire IDC contact 1 has been formed from one metal sheet by punching and bending. The contact spring 6 has been bent at a turn 35 that is located at a side of the contact spring. Therefore, the turn 35 is a longitudinal turn 35A.

Although exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An IDC contact for an electrical plug, the IDC contact comprising:

a wire contact section having a cable receiving opening at a proximal end thereof and extending into a slotted cable receiving section, and a secondary contact section having a contact spring extending from and positioned adjacent to the wire contact section, and a contact arm extending from the contact spring to a contact point alongside the cable receiving opening at a distal end thereof for electrically contacting an external element.

2. The IDC contact according to claim 1, wherein the contact spring includes a plurality of compressible folded sections.

3. The IDC contact according claim 2, wherein the compressible folded sections extend substantially perpendicular to the slotted cable receiving section.

4. The IDC contact according claim 3, wherein the contact arm extends substantially parallel to the slotted cable receiving section.

5. The IDC contact according to claim 1, wherein the contact spring is connected to the wire contact section along a base portion thereof.

6. The IDC contact according to claim 5, wherein the base portion is positioned opposite the proximal end.

7. The IDC contact according to claim 6, wherein the wire contact section and the secondary contact section include opposing planar surfaces.

8. The IDC contact according to claim 7, wherein the opposing planar surfaces are positioned parallel to each other.

9. The IDC contact according to claim 8, wherein a width of the contact spring is smaller than a width of the base portion.

10. The IDC contact according to claim 1, further comprising a backup spring attached to the wire contact section.

11. The IDC contact according to claim 10, further comprising a securing piece connecting the backup spring to the wire contact section along a distal end thereof.

12. The IDC contact according to claim 10, wherein the backup spring is bent from the wire contact section along a distal end thereof.

13. The IDC contact according to claim 10, further comprising a fastener pin disposed at a proximal end of the backup spring and engaging the wire contact section.

14. The IDC contact according to claim 10, wherein the backup spring includes bladelike edges located on the proximal end.

15. An IDC contact for an electrical plug, the IDC contact comprising:

a wire contact section having a cable receiving opening, and a pair of secondary contact sections positioned on opposite sides of the wire contact section, each secondary contact section having a contact spring extending from and positioned adjacent to the wire contact section and a contact arm extending from the contact spring in the direction of the cable receiving opening.

16. The IDC contact according to one claim 15, wherein the pair of secondary contact sections includes a pair of contact points positioned at proximal ends thereof.

17. The IDC contact according to claim 16, wherein the pair of contact points are positioned along opposite ends of the cable receiving opening.

18. The IDC contact according to claim 17, wherein one of the pair of contact points extends beyond the cable receiving opening.

19. The IDC contact according to claim 18, wherein the pair of secondary contact sections are axially symmetric to each other.

20. The IDC contact according to claim 19, wherein the wire contact section and the pair of secondary contact sections are integrally formed from a metal sheet with the pair of secondary contact sections folded back from the wire contact section.

21. The IDC contact according to claim 16, wherein the contact spring includes a plurality of compressible folded sections.

22. The IDC contact according claim 21, wherein the wire contact section includes a slotted cable receiving section extending from the cable receiving opening and away from the pair of contact points.

23. The IDC contact according claim 22, wherein the compressible folded section extends substantially perpendicular to the slotted cable receiving section.

24. The IDC contact according to claim 16, wherein the contact spring connects to the wire contact section along a base portion thereof.

25. The IDC contact according to claim 24, wherein the base portion is positioned opposite the proximal end.

26. An IDC contact for an electrical plug, the IDC contact comprising:

a wire contact section having a cable receiving opening at a proximal end thereof and extending into a slotted cable receiving section, and a secondary contact section having a contact spring extending from and positioned adjacent to the wire contact section, the contact spring crossing the cable receiving section, and a contact arm extending from the contact spring and extending to a contact point alongside the cable receiving opening.

27. The IDC contact according to claim 26, wherein the contact spring includes a plurality of compressible folded sections.

28. The IDC contact according claim 27, wherein the compressible folded sections extend substantially perpendicular to the slotted cable receiving section.

29. The IDC contact according claim 28, wherein the contact arm extends substantially parallel to the slotted cable receiving section.

30. The IDC contact according to claim 26, wherein the contact spring is connected to the wire contact section along a base portion thereof.

31. The IDC contact according to claim 30, wherein the base portion is positioned opposite the proximal end.

32. The IDC contact according to claim 31, wherein the wire contact section and the secondary contact section include opposing planar surfaces.

33. The IDC contact according to claim 32, wherein the opposing planar surfaces are positioned parallel to each other.

34. The IDC contact according to claim 33, wherein a width of the contact spring is smaller than a width of the base portion.

* * * * *